United States Patent [19]

Voles

[11] 4,370,914

[45] Feb. 1, 1983

[54] AIMING ARRANGEMENTS

[75] Inventor: Roger Voles, London, England

[73] Assignee: E M I Limited, Hayes, England

[21] Appl. No.: 895,488

[22] Filed: Apr. 6, 1978

[30] Foreign Application Priority Data

Apr. 7, 1977 [GB] United Kingdom ..... 14729/77

[51] Int. Cl.[3] ..... F41G 1/00

[52] U.S. Cl. ..... 89/41 TV; 89/41 ME

[58] Field of Search ..... 89/41 TV, 41 ME; 358/105, 108

[56] References Cited

U.S. PATENT DOCUMENTS

| | | | |
|---|---|---|---|
| 3,659,494 | 5/1972 | Philbrick et al. | 89/41 ME |
| 3,798,795 | 3/1974 | Michelsen | 89/41 TV |
| 3,947,833 | 3/1976 | Eckstein, Jr. | 358/108 X |
| 4,028,991 | 6/1977 | Kuby | 89/41 ME |

*Primary Examiner*—Theodore M. Blum

*Attorney, Agent, or Firm*—Fleit & Jacobson

[57] ABSTRACT

A gun aiming arrangement uses a visible light or infrared television camera to feed target area data to an auto-lock-follow (ALF) circuit. The ALF circuit is caused to lock onto a part of the area chosen using a sighting arrangement operated by the gunman. The gun automatically fires when the deviation between the aim of the gun and the target as sensed by the ALF circuit has a predetermined characteristic.

19 Claims, 3 Drawing Figures

AIMING ARRANGEMENTS

The present invention relates to gun aiming arrangements.

According to the invention there is provided

A gun aiming arrangement comprising:

(a) camera means for receiving an image of a target area and adapted to sample the image to produce signals representing the image;

(b) means for indicating the target area to an operator;

(c) an auto-lock-follow circuit, (d) a target selecting means for rendering the auto-lock-follow circuit preferentially sensitive to a selected zone of the area;

(e) manually operable means for causing the selecting means to select the said zone of the area;

the auto-lock-follow circuit being connected to receive the said signals from the camera and means being connected to the selecting means to respond to the said signals and the selected zone to indicate the position of the said zone in the target area;

(f) means responsive to the auto-lock-follow circuit to produce a firing signal for firing the gun when the deviation of the indicated position from the aim of the gun has a predetermined characteristic; and (g) manually operable switching means for selectively connecting the auto-lock-follow circuit to the firing signal producing means.

Figure 1:
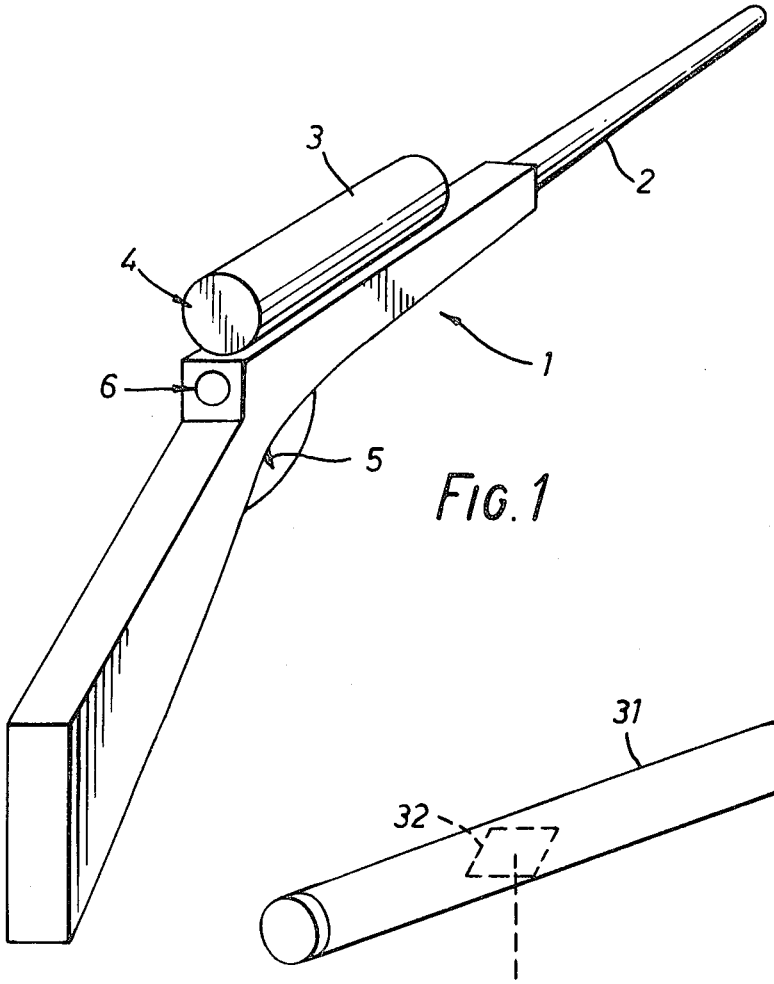
Figure 3:
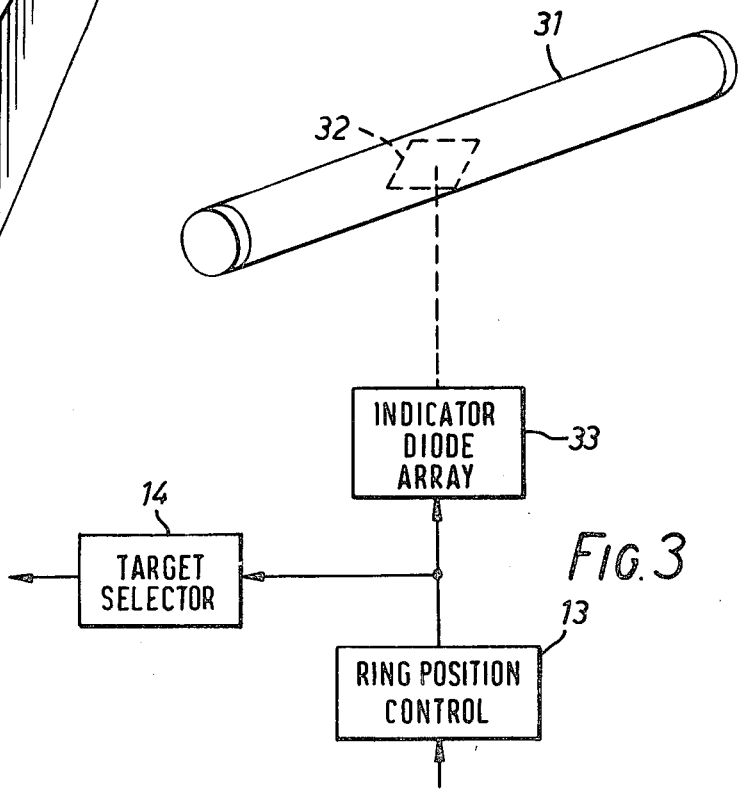
Figure 2:
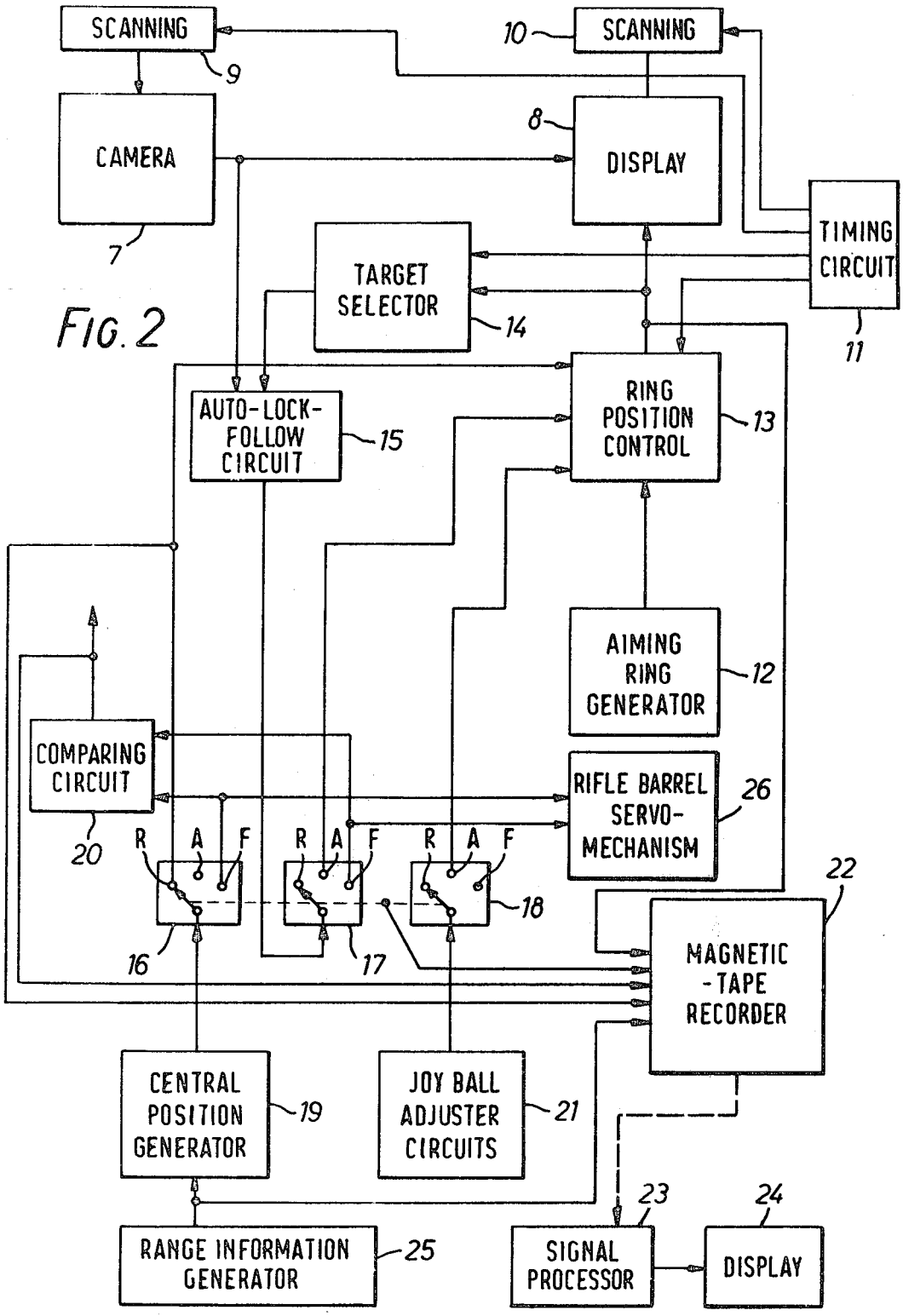

In order that the invention may be clearly understood and readily carried into effect, one embodiment thereof will now be described, by way of example only, with reference to the accompanying drawings of which:

FIG. 1 shows, in perspective view, a rifle in accordance with one example of the invention, FIG. 2 shows a block diagrammatic circuit arrangement suitable for incorporation in the rifle shown in FIG. 1; and FIG. 3 is a schematic diagram of a modification of the arrangement of FIG. 2.

Referring now to FIG. 1, there is shown, in perspective view, a rifle 1 in accordance with one example of the invention. Mounted above the barrel 2 of the rifle, in the same way as a noctoscope or telescope, is a housing 3 which contains a minature television camera, the light-sensitive element of which comprises, for example a charge coupled device or a pick-up tube. A display screen 4 is mounted at the rear of the housing 3. The rifle has a trigger 5 which has three positions, known as 'RELAXED', 'ALF' and 'FIRE' respectively and the operation of the rifle with the trigger in these different positions will be described in more detail later. Mounted behind the trigger and above the stock of the rifle is a small joyball 6, of known kind, which the rifleman can control with his thumb for a purpose which will be described in more detail hereinafter.

Reference will now be made to FIG. 2, in which there is shown, in block diagrammatic form, a circuit arrangement suitable for incorporation in the rifle shown in FIG. 1. A minature television camera 7 is mounted in the housing 3 (FIG. 1) so as to view a target area. The camera 7 may include, as the light-sensitive and light-to-electrical signal conversion element thereof, a charge coupled device or a minature pick-up tube (e.g. a vidicon tube). The electrical signals derived, either by scanning in the conventional way (if the camera includes a pick-up tube) or by commutation (if the camera includes a charged coupled device) are applied to a suitable display 8 mounted at the rear of housing 3 and facing rearwardly therefrom. Blocks 9 and 10 indicate scanning (or commutation) arrangements of conventional kind associated with the camera 7 and the display 10 respectively; both being operated under the control of a main timing circuit 11.

An aiming ring outline generator 12 generates a circular or elliptical outline which can be superimposed upon the scene displayed by the display 8 for aiming purposes, as will be described later, and the generator 12 is connected to the display by way of a ring position control circuit 13. The circuit 13 is operated under the control of the timing circuit 11, as well as other circuits which will be referred to later, and is effective to control the positioning of the aiming ring on the display 8. The display 8 also carries a conventional aiming (e.g. cross-wire) mark which may be fixed in relation to the display or may be moveable relative to the display as described hereinafter.

A target selection circuit 14, also controlled by the timing circuit 11, is connected to receive the output of the ring position control circuit 14. Circuit 14 is arranged to render an auto-lock follow (A.L.F.) circuit 15, which receives the signals provided by camera 7, preferentially sensitive to target information enclosed by the aiming ring. The target information becomes the so-called "inner-patch" information applied to the A.L.F. circuit 15 and it is this information to which the A.L.F. circuit locks, and which it follows.

A bank of three ganged switches, 16, 17 and 18, is provided to permit the arrangement to operate in a number of modes. The switches are shown as single pole, three-way mechanical switches, but this is done for clarity of illustration only and it will be appreciated that the switches could take the form of semi-conductor devices such as field-effect transistors. Each switch has three positions, and these are marked "R", "A" and "F" in each case; the symbols relate to the three positions which can be assumed by the trigger of the rifle, the positions being "Relaxed", "Auto-lock-follow" and "Fire" respectively.

The switch 16 is effective, in its "R" condition, to connect a central position generator 19 to the ring position control circuit 13 to cause the aiming ring to be disposed centrally of the display 8. The position generator 19 provides the coordinates of the centre of the conventional aiming mark (i.e. cross-wires). In its "A" position, the switch 16 disconnects the central position generator 19 from all other circuits. In its "F" position, however, switch 16 connects generator 19 to a comparison circuit 20 for a reason which will become clear hereinafter.

The pole of switch 17 is connected to the output of the A.L.F. circuit 15 and, in its "R" position, it serves to disconnect the circuit 15 from all other circuits. In its "A" position, switch 17 connects the A.L.F. circuit 15 to the ring position control circuit 13 so that the aiming ring, as displayed on display 8, can move to track the selected target. At this stage also, the control circuits 21 actuated by the joyball 6 enable the target to be reselected, or its centralisation within the aiming ring to be improved, manually by the rifleman. This is achieved via the switch 18 in its "A" position which establishes a connection between the circuits 21 and the ring position control circuit 13.

Finally, with switch 17 in its "F" position, the output of the A.L.F. circuit 15 is applied as the other input to the aforementioned comparison circuit 20. It is to be noted that, when the switches 16–18 are in the "F" position (and it will be recalled that the switches are ganged so as to operate synchronously) the ring position control circuit receives no command inputs, only the timing signals from circuit 11. Under these circumstances, the ring is extinguished and the target selector circuit 14 becomes inoperative so that the A.L.F. circuit 15 is not supplied with confusing information after the target has been finally selected during the auto-lock-follow stage of operation. Only the conventional aiming mark is then left on the display.

The operation of the arrangement will now be described in more detail. The trigger is arranged to fire the round electrically and, as aforementioned, goes through an intermediate "auto-lock" position in passing from the "relaxed" to the "fire" position.

When the trigger is in its "relaxed" or "R" position, the aiming ring is in the centre of the display screen and, also central on the conventional aiming mark (e.g. crosswires). The rifleman then engages a target by aiming the rifle so that the image of the target appears within the (centred) aiming ring, at which point he partially depresses the trigger to the "A" position. This action initiates the autolock-follow processor and causes it to track the object which was initially within the aiming ring and, in this mode, to move the aiming ring on the display so as to remain superimposed on the designated target.

Provided that the rifleman continues to steer the rifle so that the target does not escape from his screen the autolockfollow system continues to keep the aiming ring on the target. During this phase, the rifleman is able to refine the position of his aiming ring, if necessary, by simply adjusting the joyball appropriately with his thumb.

Ultimately, when he is satisfied that he has defined the aiming point as accurately as necessary, the rifleman pulls the trigger hard over to the "F" position and attempts to aim the rifle's conventional aiming mark onto the target. The comparison circuit 20 now measures the deviation of the centre of the target being tracked by the A.L.F. from the conventional aiming mark of the rifle and, when this deviation is less than a prescribed value, fires the round electrically. By this means, the round is fired only when the rifle is pointing accurately at the designated target. The effects of rifleman tremor or of erratic movement of the target only delay the firing instant:- ultimately, the gun and target will come into line and the round will be fired.

As described hereinbefore the rifleman views the target area via the display screen. The camera can be provided with an image intensifier to provide a useful night-time capability. On the other hand, it is not a necessary feature as the system can, as shown in FIG. 3, alternatively be arranged so that the rifleman views the target area directly through his aiming optics or telescope 31 and the aiming ring is simply projected onto a partially-silvered mirror 32 interposed at a suitable point. The camera is then mounted alongside the aiming optics and the rest of the system remains unchanged. The advantage of this type of arrangement is that the only electronic display required is a simple aiming "ring". In this case, the "ring" would probably be arranged to be the usual "open cross". The aiming indicator could be generated by an array 33 of light emitting diodes. In such cases in order to change the apparent position of the aiming indicator in the field of view, the position control 13 selects which diodes of the array are to emit light at any time.

If the aiming indicator is generated by light-emitting diodes, the conventional aiming mark can conveniently be produced in the same way.

For long-range operation, the gravity-drop of the bullet must be allowed for. One way of achieving this is to require the rifleman to "clock-in" the estimated range on thumb-wheels of a range information generator 25. This range information is passed to the central position generator 19 to depress the conventional aiming crosswires on the display appropriately. A small indicator in the field of view can be arranged to remind the rifleman of the setting of his range.

The criterion for firing the rifle can be input as a variety of alternatives. If the system has a "knowledge" of estimated range, the angular deviation criterion can be set to be a prescribed linear miss distance (in, say, multiples of 5 cm) divided by the input range. If the target is another man, then the required error tolerance is an ellipse having a vertical axis, say, three times larger than the horizontal axis. Consequently, the autolock system can be arranged to fire as soon as the conventional aiming mark falls within the corresponding angular ellipse. The provision of an elliptical tolerance is consistent also with the fact that running men tend to translate laterally in the field of view and not vertically. Consequently, the trained rifleman will steer his rifle accurately in elevation (where the required accuracy is relatively low) and then sweep it across the target azimuthally so that the effects of target motion and his own tremor are cancelled-out with certainty during the sweep.

For training purposes, the image seen by the camera can be read-out together with the positions of the aiming ring when the trigger is pulled to the "fire" position and at the "firing" instant, together with the elapsed times for the various phases of the engagement and the setting of the estimated range. At the butts, the storage can be effected centrally, the rifles in use having leads plugged into them for data transfer. For use on the training range, it is desirable to record the "scenes", corresponding to each firing, using a cassette tape recorder 22—possibly stowed in the butt of the rifle. Either way, on replay using a suitable processor 23 for processing the data and a display 24, the instructor has a direct indication of the target-designation skill of the trainee rifleman, together with his rate of effective fire.

If the typical target for a rifleman is at a range of 200 m and if the camera optics have a magnification of 16X and an exit field of 30°, then the field of view at the target has a lateral diameter of about 6 m. In order to "recognise" a man (as such, according to Johnson's criterion) requires a resolution of 8 lines across his shoulders corresponding to a resolution of about 6 cm. Consequently, the required resolution of the camera is about 85 lines. CCD sensor chips having twice this resolution are readily available today. One solution is to adopt a 100×100 sensor and to use it in conjunction with optics of alternative magnification.

If the camera display is to be used for direct viewing by the rifleman, as opposed to using a separate aiming telescope as described above, it may be necessary to restrict the magnification of the optics to about 4X for ease of operation. In this case a larger CCD sensor (about 350×350) would have to be used to maintain the resolution required.

Against the human target, the auto-lock-follow patch should be only about 40 cm wide by about 120 cm high; corresponding to 6×17 "pixels" in the case taken above. In some situations of relatively large magnifications or close range it is likely that the inner patch may be required to be as large as, say 10×30 "pixels".

The criterion for firing can be improved by requiring not only that the angular deviation falls inside a prescribed ellipse but also that the rate of change of the deviation is zero. This then causes the firing to be delayed until the rifle is aimed as accurately as possible during that period of time.

In regard to the ergonomics of such a rifle, it can be convenient to free the RH trigger finger for controlling the joyball and to use the RH thumb for "firing". With certain types of rifle or gun, the LH holds a grip so in these cases the LH can be provided with the trigger.

The size of the ALF inner patch can be made selectable by the operator so that when aiming at a stationary target he can use the whole of the sensor array, or, at the other extreme, when aiming at the smallest moving (or potentially-moving) target he could use a relatively small inner patch.

Once the aiming ring has been set onto the target, the gun if powered can point itself using a servo-mechanism 26 operating in dependence upon the ALF circuit. One way to obtain this power is by manual pumping of an air reservoir or, preferably, by bleeding-off some of the cartridge gas and using this to maintain the pressure. Either way, the servo-action can be obtained by using a grip for the LH and then using the air motors to move the rifle barrel with respect to the grip so as to aim it accurately at the target being tracked. With such a weapon, there is no need to provide a conventional aiming crosswire.

Various further modifications may be made. For instance, instead of using a television camera sensitive to visible light, a television camera sensitive to infra-red radiation may be used.

Furthermore, it will be appreciated that the invention is applicable to guns of any calibre as well as to infantry rifles, although the invention is especially applicable to infantry rifles if advantage is taken of the availability of miniature television cameras, utilising, for example, charge coupled devices or miniature pick-up tubes, and the use of known technology in the field of auto-lock-follow (ALF).

What I claim is:

1. A gun aiming arrangement comprising:

(a) camera means for receiving an image of a target area and adapted to sample the image to produce signals representing the image;

(b) means for indicating the target area to an operator;

(c) an auto-lock-follow circuit, (d) a target selecting means for rendering the auto-lock-follow circuit preferentially sensitive to a selected zone of the area;

(e) manually operable means for causing the selecting means to select the said zone of the area;

the auto-lock-follow circuit being connected to receive the signals from the camera and means being connected to the selecting means to respond to the said signals and the selected zone to indicate the position of the said zone in the target area;

(f) means responsive to the auto-lock-follow circuit to produce a firing signal for firing the gun when the deviation of the indicated position from the aim of the gun has a predetermined characteristic; and (g) manually operable switching means for selectively connecting the auto-lock-follow circuit to the firing signal producing means.

2. An arrangement according to claim 1, wherein the camera comprises a charge-coupled device image sensor.

3. An arrangement according to claim 1, wherein the camera comprises a miniature image sensing tube.

4. An arrangement according to claim 1, wherein the sensing means comprises an infra-red radiation sensor.

5. An arrangement according to claim 1, wherein the indicating means comprises an optical sighting device.

6. An arrangement according to claim 5, wherein the target selecting means comprises an indicator, means for projecting an image of the indicator into the sighting device to indicate the said zone, and means responsive to the causing means for controlling the position of the projected image, and a target selector circuit responsive to the position controlling means to render the auto-lock-follow circuit preferentially sensitive to the said zone.

7. An arrangement according to claim 1 wherein the indicating means comprises a display means connected to the camera means to produce an image of the target area from the said signals representing the image.

8. An arrangement according to claim 7, wherein the target selecting means comprises indicator generating means for causing the display means to display a target indicator, indicator position control means responsive to the causing means to select the position of the indicator on the displayed image of the target area and thus the said zone, and a target selector circuit responsive to the position control means to render the auto-lock-follow circuit preferentially sensitive to the said zone.

9. An arrangement according to claim 6 or 8 wherein the said switching means is connected to selectively connect the auto-lock-follow circuit to the target selecting means and to the firing signal producing means.

10. An arrangement according to claim 7 or 8 wherein the firing signal producing means comprises an aiming mark generator for causing the display means to display a mark indicating the aim of the gun, and a comparator responsive to the aiming mark generator and the auto lock follow circuit to produce the firing signal.

11. An arrangement according to claim 10 wherein the said switching means is connected to selectively connect the auto-lock-follow circuit to the target selecting means and to the firing signal producing means and to selectively connect the aiming mark generator and the auto-lock-follow circuit to the comparator.

12. An arrangement according to claim 1, further comprising means for supplying to the firing signal producing means data relating to the range of the target.

13. An arrangement according to any one of claims 2, 8 and 1 further comprising a servo mechanism for moving the barrel of the gun in dependence upon the deviation of the position of the said zone sensed by the auto-lock-follow circuit from the aim of the gun.

14. An arrangement according to claim 1, in combination with storing means connected to receive various signals produced by the arrangement and to cause the storing of data represented by those signals.

15. An operator training system comprising an arrangement according to claim 14, and an operator monitoring means for processing the stored data to indicate the performance of the operator.

16. An arrangement according to claim 14, wherein the storing means comprises a magnetic-tape recorder 17. A gun comprising an arrangement according to claim 1 and arranged to fire in response to the firing signal.

18. A gun according to claim 17, which is an infantry rifle.

19. An operator training system comprising an arrangement according to claim 1, and an operator monitoring means for processing signals produced by the arrangement in operation thereof to indicate the performance of the operator.

* * * * *